US010131471B2

(12) United States Patent
Elder et al.

(10) Patent No.: US 10,131,471 B2
(45) Date of Patent: Nov. 20, 2018

(54) BOTTLE CLOSURE HAVING A WOOD TOP

(71) Applicant: Multiject LLC, Rochester, MI (US)

(72) Inventors: Jack E. Elder, Oakland Township, MI (US); Geoffrey Odhner, Detroit, MI (US)

(73) Assignee: Multiject LLC, Rochester, MI (US)

( * ) Notice: Subject to any disclaimer, the term of this patent is extended or adjusted under 35 U.S.C. 154(b) by 0 days.

(21) Appl. No.: 15/420,867

(22) Filed: Jan. 31, 2017

(65) Prior Publication Data

US 2017/0203885 A1 Jul. 20, 2017

Related U.S. Application Data

(63) Continuation-in-part of application No. 14/970,405, filed on Dec. 15, 2015, now abandoned, which is a continuation-in-part of application No. 14/015,827, filed on Aug. 30, 2013, now Pat. No. 9,211,977.

(51) Int. Cl.
*B65D 39/00* (2006.01)

(52) U.S. Cl.
CPC ..... *B65D 39/0005* (2013.01)

(58) Field of Classification Search
CPC ..... B65D 39/0011; B65D 39/0005; B65D 39/0058; B65D 39/0052; B65D 39/00; B65D 41/58; B65D 41/28; B65D 36/16
USPC ..... 215/364, 355, 228; 220/789, 787, 800, 220/801, 212; 428/35.6, 35.7; 217/79, 217/78, 76
See application file for complete search history.

(56) References Cited

U.S. PATENT DOCUMENTS

| | | | | |
|---|---|---|---|---|
| 1,721,210 | A | 7/1929 | Dalley | |
| 2,091,350 | A * | 8/1937 | Bomeisler | B65D 39/16 215/364 |
| 2,192,511 | A | 3/1940 | Thomas | |
| 2,419,743 | A | 4/1947 | Taylor | |
| 3,146,806 | A | 9/1964 | Ginsburg | |
| 4,182,458 | A | 1/1980 | Meckler | |
| 5,710,184 | A | 1/1998 | Burns | |
| 7,770,747 | B2 * | 8/2010 | Lauer | B65D 39/0005 215/299 |
| 7,886,923 | B2 * | 2/2011 | Nakada | B65D 39/0058 215/354 |

(Continued)

FOREIGN PATENT DOCUMENTS

| | | | |
|---|---|---|---|
| EP | 667298 A1 | 8/1995 | |
| GB | 26392 | 11/1906 | |
| GB | 332860 A * | 7/1930 | B65D 39/16 |

(Continued)

OTHER PUBLICATIONS

Translation of JP2002234555, (Fujita et al.), Aug. 20, 2002, Paragraphs 11, 21, and 22.*

*Primary Examiner* — Robert J Hicks
(74) *Attorney, Agent, or Firm* — Maginot Moore & Beck LLP

(57) ABSTRACT

A closure for a bottle includes a wooden head portion and a stopper portion. The wooden head portion has a recess formed therein. The stopper portion has a polymer inner member and a polymer outer member. The polymer inner member includes a first part embedded in the recess in the wooden head and a second part extending away from the wooden head and substantially covered by the polymer outer member.

17 Claims, 9 Drawing Sheets

(56) References Cited

U.S. PATENT DOCUMENTS

| | | | |
|---|---|---|---|
| 2008/0078737 | A1 | 4/2008 | Brennan |
| 2008/0116165 | A1 | 5/2008 | Lin |

FOREIGN PATENT DOCUMENTS

| | | | | | |
|---|---|---|---|---|---|
| GB | 657980 | A | * | 10/1951 | ..... B65D 39/16 |
| GB | 14711 | | | 7/1957 | |
| GB | 777991 | A | | 7/1957 | |
| JP | 2000185747 | A | * | 7/2000 | ..... B65D 39/04 |
| JP | 2002234555 | A | * | 8/2002 | ..... B65D 39/04 |

* cited by examiner

BOTTLE CLOSURE HAVING A WOOD TOP

CROSS-REFERENCE TO RELATED APPLICATIONS

This application is a continuation-in-part of U.S. patent application Ser. No. 14/970,405, filed Dec. 15, 2015, which is a continuation-in-part of U.S. patent application Ser. No. 14/015,827, filed Aug. 30, 2013, the contents of which are incorporated herein by reference in their entirety.

FIELD OF THE INVENTION

The present invention relates generally to bottle closures.

BACKGROUND OF THE INVENTION

Bottle closures for consumable liquids, for example, olive oil, syrup, spirits and wine, have historically been metal and/or cork material. Cork is made from bark of certain trees, for example, the Cork Oak. Cork has qualities particularly suited to storing liquids in bottles because it features impermeability and a certain level of compressibility that allows for both a tight closure and removability. In contrast to bark, wood fibers do not have sufficient compressibility.

Due to extensive use, however, cork supplies are limited, thereby driving up price. Moreover, cork closures carry with them the risk of a taint that can be passed into the liquid. For example, it has been estimated that as many as seven percent of wine bottles have some level of "corking", or taint imparted by the cork.

By far, the most popular closure for mass-produced bottled liquids is the metal "screw top cap". Metal screw tops are formed of a metal skirt and plastic sealing layer. Screw tops extend over the outside of the bottle, as opposed to corks that are inserted into the bottle neck. While screw top caps are not susceptible to taint, screw top caps lack aesthetic appeal, which is particularly disadvantageous for higher-valued products such as fine spirits, fine wine, and higher end olive oil and maple syrup.

In other cases, it has been found that certain polymers can be used for bottle closures that behave in a manner more similar to cork. Polymer closures can have similar compressibility. However, polymer closures similarly suffer from a lack of aesthetics associated with fine spirits, wine and other products. Furthermore, polymer closures are given to "creep", which deforms the closure over time and can lead to failure.

Some attempts have been made to combine certain materials with the polymer closure to take advantage of the mechanical properties of the polymer while improving the aesthetics. In one example, a closure includes a wooden head or cork head portion glued to a thermoplastic polymer portion. The thermoplastic polymer portion inserts into the bottle, while the wooden head remains outside the bottle and provides a gripping portion for extraction. The drawback of this design is that the glue joints often fail, causing separation of the polymer sealing material from the wood.

What is needed is a bottle closure that has sealing qualities comparable to cork, while having a suitable aesthetic human interface.

SUMMARY OF THE INVENTION

The present invention addresses the above stated need, as well as others, by providing a bottle closure having a wooden core (and head), with a polymer molded onto the wooden core. The wooden core provides structural integrity and the wooden head provides a convenient and aesthetic removal interface.

In a first embodiment, the closure for a bottle includes a wooden head portion and a stopper portion. The wooden head portion has a recess formed therein. The stopper portion has a polymer inner member and a polymer outer member. The polymer inner member includes a first part embedded in the recess in the wooden head and a second part extending away from the wooden head and substantially covered by the polymer outer member.

In another embodiment, a closure for a bottle includes a wooden element, a first polymer layer, and a second polymer layer. The wooden element has a recess formed therein. The first polymer layer is molded into the recess in the wooden element. The first polymer layer also has an outer surface with at least one circumferential discontinuity. The second polymer layer is disposed over the first polymer layer. The second polymer layer is configured to be received by a bottle in the axial direction.

In yet another embodiment, a closure for a bottle includes a wooden element having an upper surface, a lower surface, and a recess formed in the lower surface. The closure also includes a first polymer layer including a footing and an extension. The footing is molded into the recess in the wooden element, and the extension extends away from the footing and the wooden element. The footing is integrally formed with the extension as a unitary component. The closure further includes a second polymer layer molded onto the first polymer layer. The second polymer layer is configured to be received by a bottle in the axial direction.

The above-described features and advantages, as well as others, will become more readily apparent to those of ordinary skill in the art by reference to the following detailed description and accompanying drawings.

DETAILED DESCRIPTION

Figure 1:
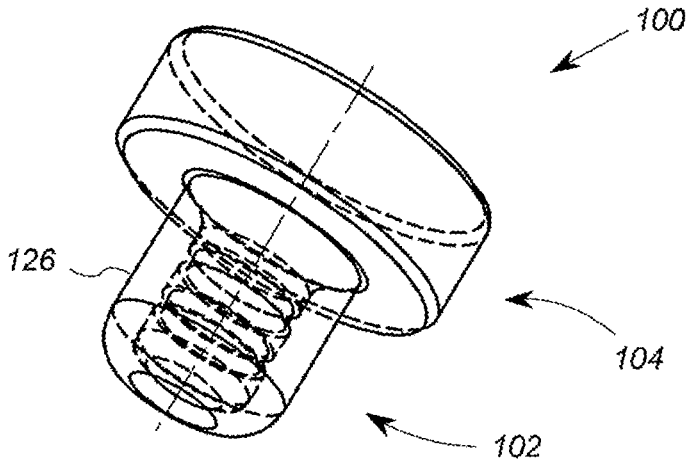
FIG. 1 shows perspective view of a bottle closure according to at least one embodiment of the invention.
Figure 2:
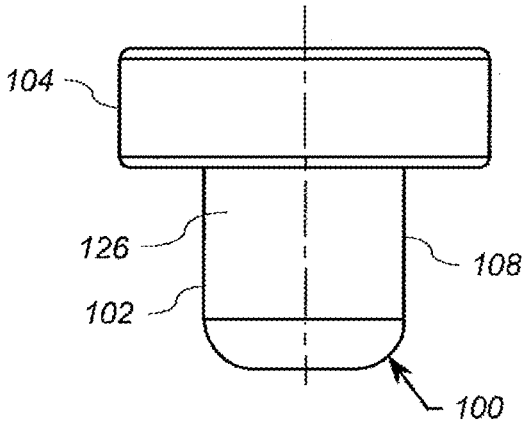
FIG. 2 shows a side plan view of the bottle closure of FIG. 1.
Figure 3:
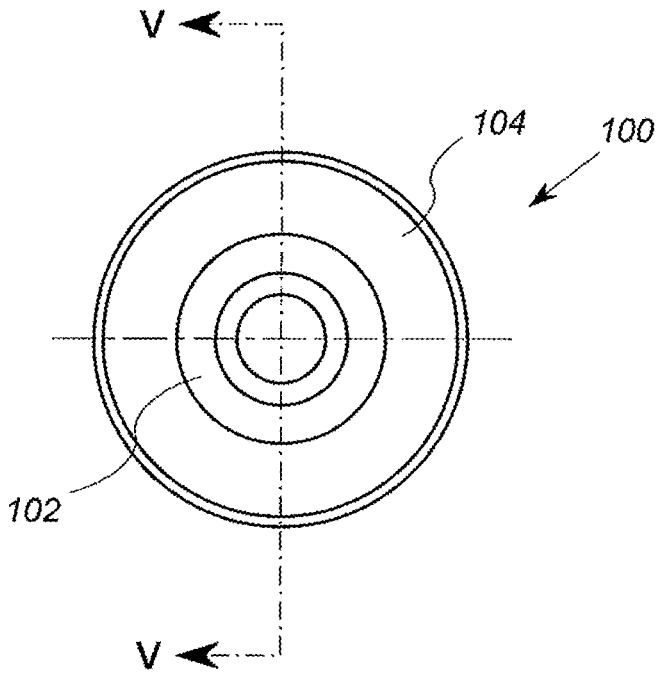
FIG. 3 shows a bottom plan view of the bottle closure of FIG. 1.

FIG. 1 shows perspective view of a bottle closure 100 according to at least one embodiment of the invention. FIGS. 2 and 3 show, respectively, side and bottom plan views of the bottle closure. Reference is made to FIGS. 1, 2, and 3 simultaneously. The bottle closure 100 includes a stopper portion 102 and a head portion 104, and includes a substantially cylindrical outer wall 126. The stopper portion 102 has an axial length and a width in the radial direction. The width of the stopper portion 102 is sized such that the stopper portion 102 can be tightly received at least in part within the neck of a bottle containing spirits, wine, olive oil, maple syrup, mineral water, and other liquids, not shown. The stopper portion 102, when received with the bottle, is slightly compressed to form a liquid tight fit within the bottle. The head portion 104 has a width that exceeds the width of the stopper portion 102, and is not received with the neck of a standard bottle, but is rather configured to abut a top axial-facing edge of the bottle, as is conventional.

Figure 4:
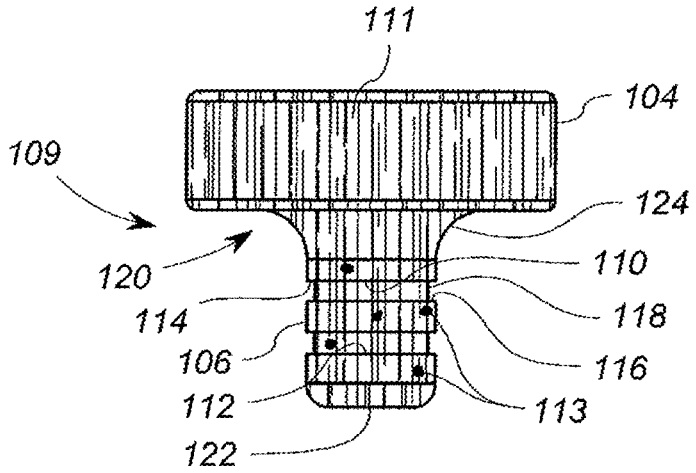
FIG. 4 shows a side plan view of a wood portion of a first or second embodiment of the bottle closure of FIG. 1.
Figure 5:
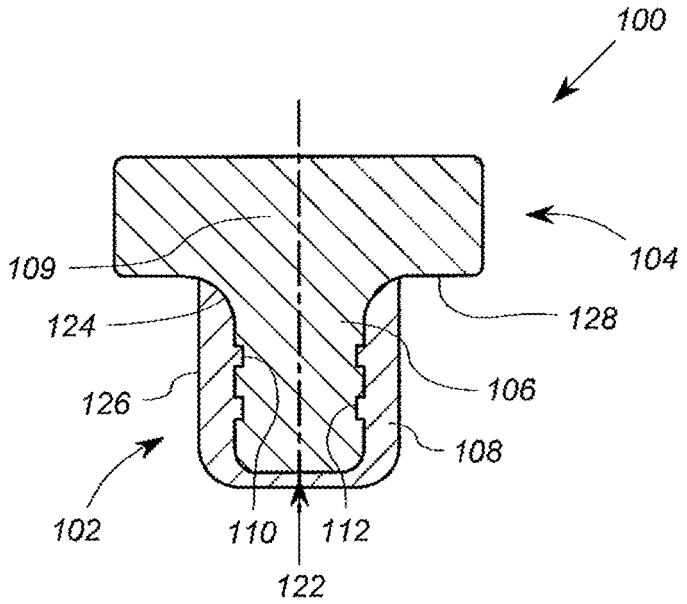
FIG. 5 shows a side cutaway view of a first embodiment of the bottle closure of FIG. 1.
Figure 6:
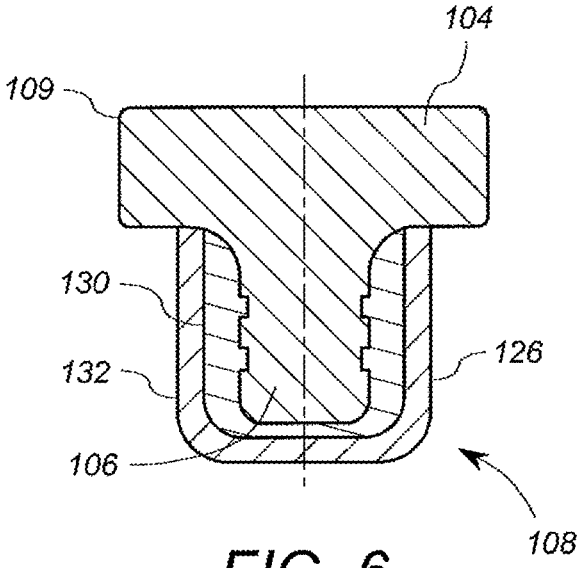
FIG. 6 shows a side cutaway view of a second embodiment of the bottle closure of FIG. 1.

With reference to FIG. 4, in addition to FIGS. 1-3, the stopper portion 102 includes a wooden inner part 106 and a polymer outer part 108. FIG. 4 shows a side plan view of the wooden inner part 106 and the head portion 104. The wooden inner part 106 and the head portion 104 are integrally formed of a single, turned piece of wood, referred to hear as the wood part 109. FIGS. 5 and 6, discussed further below, show different embodiments of the polymer outer part 108. In general, however, the polymer outer part 108 defines a substantially cylindrical outer surface 126 that is configured to engage the inner surface of the neck of a bottle.

As discussed above, the head portion 104 and the wooden inner part 106 are integrally formed from a single piece of wood, as opposed to bark material used for corks. Suitable wood materials include, but are not limited to beech, birch, maple, oak, bamboo. The wooden inner part 106 is in the form of a shaft having a first end 120 at the intersection of the head portion 104, and a distal or second end 122.

The wooden inner part or shaft 106 defines a generally cylindrical structure having at least one discontinuity. The discontinuity provides an area where the polymer outer part 108 can contract onto and "grip" the wooden inner part 106 during the molding process. In this embodiment, the discontinuities include two annular grooves 110, 112. The annular groove 110 includes a radially extending upper surface 114, a radially extending lower surface 116 and an axial inner surface 118. The annular groove 112 may suitably have the same structure. The annular grooves 110, 112 are spaced apart on the wooden inner part 106 by an axial distance that is roughly equivalent to the axial width of the axial inner surface 118. Similarly, the annular grooves 110, 112 are spaced apart from the two axial ends 120, 122 of the wooden inner part/shaft 106.

One feature of the annular grooves 110, 112 is the provision of an undercut, preferably in a radial plane. For example, in the annular groove 110, the upper surface 114 and the lower surface 116 form undercuts. As will be discussed below in further detail, when the polymer outer part 108 is molded onto the wooden inner part 106, the polymer engages the undercuts and contracts, thereby strengthening the retention force of the polymer outer part 108 on the wooden shaft 106. Accordingly, it will be appreciated that suitable undercuts may take other forms, such as detents, bores, and the like. One advantage of a continuous annular groove such as the grooves 110, 112 is that it allows the undercuts to be formed in a rotating wood working fixture, such as a lathe.

It is also preferable that the grain 111 of the wood part 109 be oriented in the axial direction, or in other words, substantially parallel to the angle of insertion into the bottle. Such orientation advantageously provides maximum bending strength on the core, and optimum fiber orientation for product insertion and extraction forces.

Accordingly, to construct the wood part 109, a blank wood piece is loaded onto a lathe or other rotating machine such that the grain of the wood blank is parallel to the axis of rotation. Suitable machining methods are used on the rotating wood blank to form the wood part 109 as shown in FIG. 4. It will also be appreciated that the machining methods typically cause random chipping-out, or random hollow spots 113, which create their own discontinuities that aid in the bonding of the polymer material to the wood shaft 106.

In this embodiment, the wooden shaft 106 also includes an annular mold mating structure 124 at the first end 120, adjacent to an engaging the underside of the head portion 104. The annular mold mating structure 124 in this embodiment defines an inclined annular surface similar to a fillet structure. The annular mold mating structure 124 is configured to provide an interface for the molding fixture, not shown. The molding fixture can clamp down and slightly deform the mating structure 124 to form a tight contact ring between the mold and the shaft, thereby inhibiting or preventing undesirable leaks or flashing of the polymer material beyond its intended position.

As discussed above, the polymer outer part 108 defines a substantially cylindrical outer wall 126 that engages the inner wall of a bottle. In a first embodiment discussed below in connection with FIG. 5, the polymer outer part 108 consists of a single, molded polymer that is molded over the wooden shaft 106. In a second embodiment discussed below in connection with FIG. 6, the polymer outer part 108 consists of at least two molded polymers having different physical characteristics.

Referring to FIG. 5, shown is a side cutaway view of the first embodiment of the bottle closure 100 of FIG. 1 having a single, molded polymer structure. Like reference numbers will be used to illustrate like features from FIGS. 1 to 4. The polymer outer layer 108 is a single material molded onto the shaft portion to form a substantially cylindrical outer surface 126 configured to be received by a bottle in the axial direction. To this end, the mold, not shown, comprises a negative of the outer cylindrical surface 126 of the polymer outer layer 108. The mold is clamped against the annular mold mating structure 124 to prevent polymer material from flashing out to the underside 128 of the head portion 104.

It can be seen that the polymer outer layer 108 fills the annular grooves 110, 112, and forms a layer over the second end 122 of the wooden shaft 106. In the cross-section shown in FIG. 5, the polymer outer layer 108 makes up between 25% and 75% of the width of the stopper portion 102. The resulting thickness of the wood shaft 106 provides strengthening characteristics not present in the polymer material.

When the polymer cures, it contracts (shrinks), forming axial clamping forces on the undercuts (e.g. radially extending surfaces 114, 116) and on the second end 122 of the wooden shaft 106. The polymer preferably shrinks at least one or two percent. Such clamping forces help secure the structure and prevent failure or separation. In addition, the random "pitting" or hollow spots 113 on the shaft 106 formed during the manufacturing process provides places for the polymer to lock during post-molding shrinkage to enhance the mechanical bond. This method of mechanical shrinkage bonding provides superior torque resistance between the wood shaft 106 and the polymer shaft 108. Such torque resistance is particularly advantageous because this type of closure is often rotated, relative to the bottle, upon insertion and extraction. Also, the porosity and pits in the wood (imperfections) provide excellent asymmetric, random grip points for the shrink bond of the molded polymer.

Accordingly, the material of the polymer outer portion 108 should be chosen such that it is soft or elastic enough to allow for bottle insertion and extraction, while providing a tight liquid seal, and have sufficient hardness to secure itself about the wooden shaft 106. To this end, the polymer may suitably be one or more of propylene, thermoplastic elastomer, a blowing agent (endothermic), or SEBS. One suitable blend is the TPE and blowing agent described in U.S. Pat. No. 5,710,184.

FIG. 6 shows a second embodiment of the bottle closure wherein the polymer outer layer 108 includes a first polymer layer 130 and a second polymer layer 132. The first polymer layer 130 preferably includes a hard polymer layer 130 molded onto the wooden shaft 106 similar to method described above in connection with FIG. 5. A second polymer layer 132 is molded onto the first polymer layer 130, and forms the outer cylindrical wall 126 of the polymer outer layer 108. The molding process creates a cohesive bond between the second polymer layer 132 and the first polymer layer 130.

The first polymer layer 130 has a greater hardness, and may have greater shrinkage, than the second polymer layer 132, thereby allowing for strong coupling to the wood shaft 106. The second polymer layer 132 may be softer, and even softer than the polymer material of the embodiment of FIG. 1, because the second polymer layer 132 has a cohesive bond to the first polymer layer 130. The combination of the layers 130 and 132 make for a strong closure device, with enhanced flexibility for insertion into and retraction out of the bottle. The wooden shaft 106, as with the embodiment of FIG. 5, provides strength and prevents degradation of the structural soundness of the polymer over time, which can be an issue with all polymer closures.

In one preferred embodiment the first polymer layer 130 may include polypropylene and the second polymer layer 132 may include thermoplastic elastomer (TPE). However, either or both of these materials may be altered.

Figure 7:
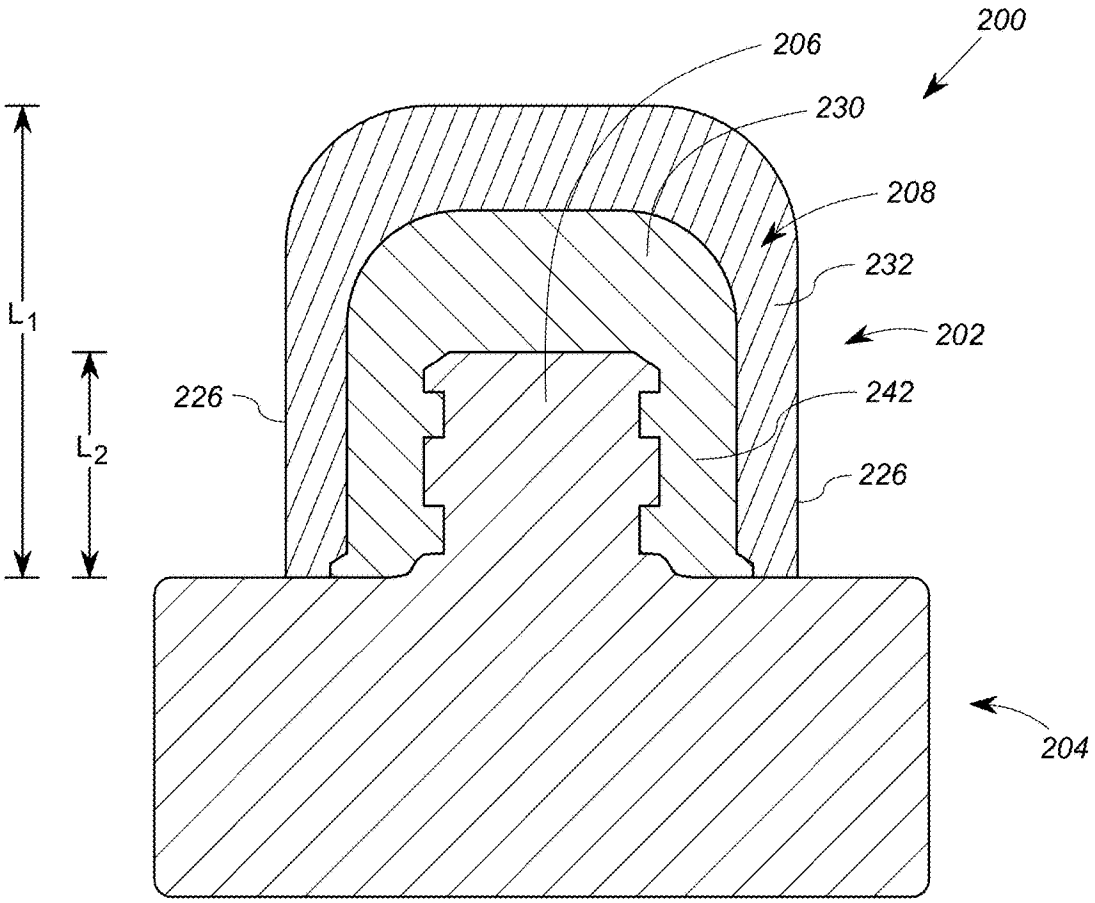
FIG. 7 shows a side cutaway view of an alternative, third embodiment of a bottle closure.
Figure 8:
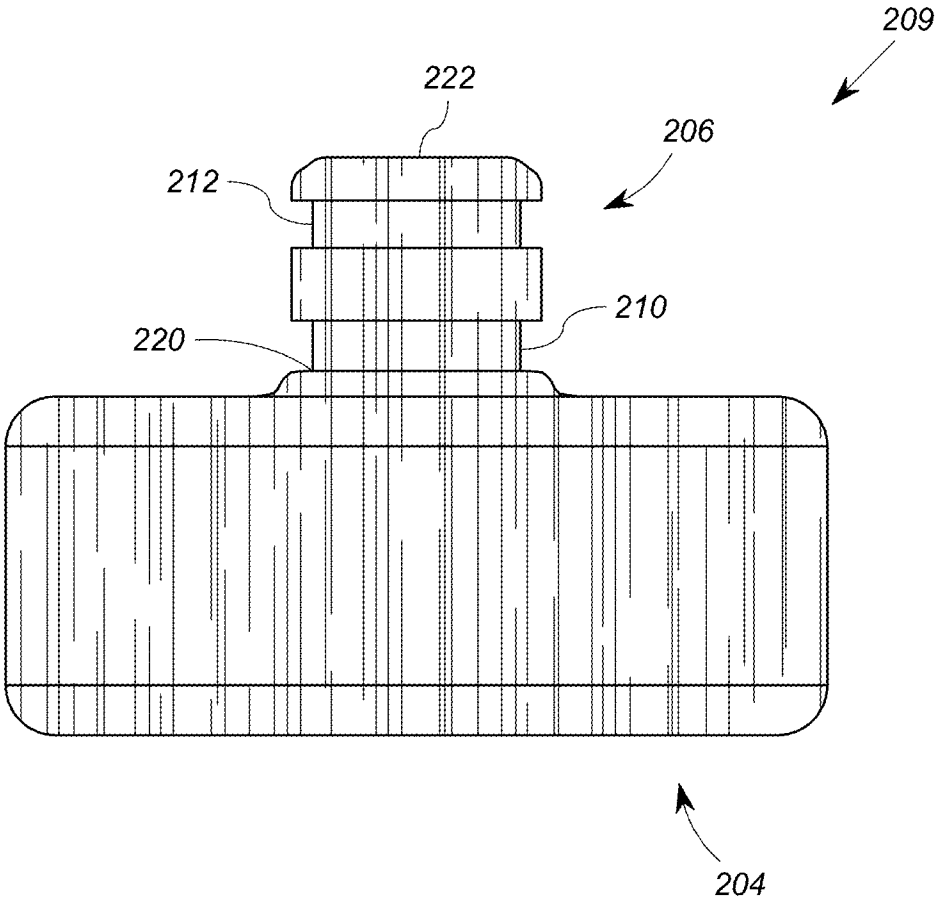
FIG. 8 shows a side plan view of a wood portion of the bottle closure of FIG. 7.
Figure 9:
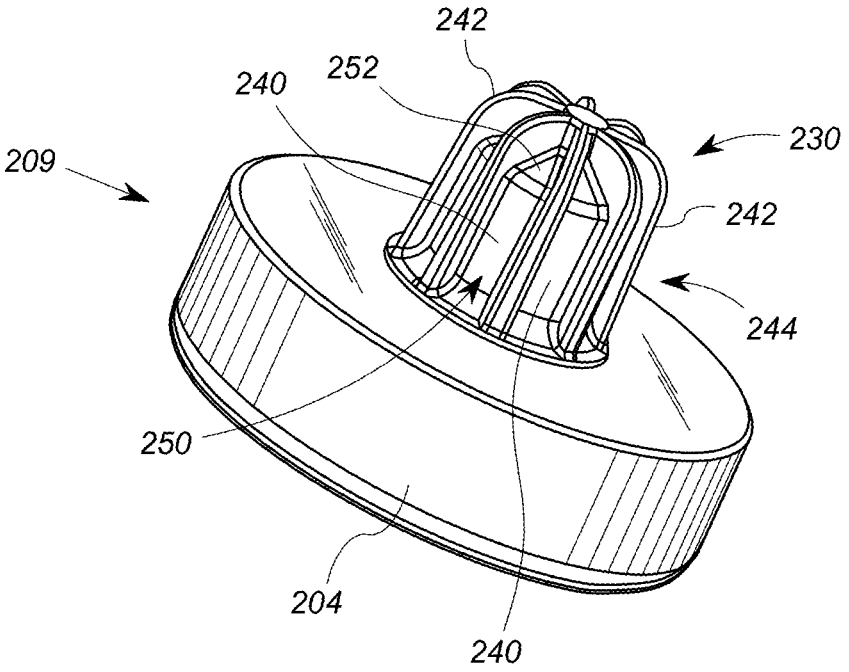
FIG. 9 shows a perspective view of the wood portion and a first polymer layer of the bottle closure of FIG. 7.

FIGS. 7, 8 and 9 illustrate an alternative embodiment of the bottle closure of FIG. 6. FIG. 7 shows a side cutaway view of a bottle closure 200 according to this alternative embodiment. The bottle closure 200 may suitably have an external appearance that is substantially identical to that of the closure 100, and thus has a plan view substantially identical that shown in FIG. 2. However, the internal structures of the bottle closure 200 differ from those of the bottle closure 100, as will become readily apparent upon review of FIGS. 7, 8 and 9.

Referring now to FIG. 7, the alternative bottle closure 200 includes a stopper portion 202 and a head portion 204, and includes a substantially cylindrical outer wall 226. The stopper portion 202 has an axial length and a width (OD of the outer wall 226) which may suitably the same as that of the stopper portion 102 of the closure 100. In other words, the width of the stopper portion 202 is sized to be tightly received at least in part within the neck of a bottle containing spirits, wine, olive oil, maple syrup, mineral water, and other liquids, not shown. As with the stopper portion 102, the stopper portion 202 is slightly compressed when inserted to form a liquid tight fit within the bottle. The head portion 204 has a width that exceeds the width of the stopper portion 202, and is not received with the neck of a standard bottle, but is rather configured to abut a top axial-facing edge of the bottle, as is conventional.

The stopper portion 202 includes a wooden inner part 206 and a polymer outer part 208, the polymer outer part including a first polymer layer 230 and a second polymer layer 232. Further details regarding the polymer outer part 208 are discussed further below in connection with FIG. 9.

FIG. 8 shows a side plan view of the wooden inner part 206 and the head portion 204 apart from the polymer outer part 208. The wooden inner part 206 and the head portion 204 are integrally formed of a single, turned piece of wood, referred to hear as the wood part 209. Similar to the wood part 109, the head portion 204 and the wooden inner part 206 are integrally formed from a single piece of wood, as opposed to bark material used for corks. Suitable wood materials include, but are not limited to beech, birch, maple, oak, bamboo. The wooden inner part 206 is in the form of a shaft having a first end 220 at the intersection of the head portion 204, and a distal or second end 222.

The wooden inner part or shaft 206 defines a generally cylindrical structure having at least one discontinuity. The discontinuity provides an area where the polymer outer part 208 can contract onto and "grip" the wooden inner part 206 during the molding process. In this embodiment, the discontinuities include two annular grooves 210, 212. Thus, the shaft 206 is similar to the shaft 106 shown in FIG. 4. However, in contrast to the shaft 106 of FIG. 4, the shaft 206 has an axial length $L_2$ that is less than 75%, and preferably less than 50% of the overall axial length $L_1$ of the stopper portion 202. (See FIG. 7). This allows for a reduction in the amount of wood that is used, which is replaced by lower cost polymer materials of the polymer outer part 208. As with the shaft 106 discussed above in connection with FIG. 4, discontinuities in the shaft 206 can take other forms. Moreover, the shaft 206 need not have a general cylindrical shape at all. The shaft 206 may suitably have other features as those of the shaft 106, and may be formed in the same way.

Moreover, it will be appreciated that the reduced length shaft 206 may readily be employed in the embodiments of the closure 100 discussed above in connection with FIGS. 1 to 6. Conversely, the polymer outer part 208 of FIG. 7 may be implemented with the longer shaft 106 of FIG. 4. Nevertheless, the reduced length of the shaft 206 is particularly advantageous because it can provide material cost reduction.

As discussed above in connection with FIG. 7, the polymer outer part 208 includes a first polymer layer 230 and a second polymer layer 232. As with first polymer layer 130 of the embodiment of FIG. 6, the first polymer layer 230 preferably includes a hard polymer layer 230 molded onto the wooden shaft 206 similar to method described above in connection with FIG. 5. A second polymer layer 232 is molded onto the first polymer layer 230, and forms the outer cylindrical wall 226 of the polymer outer layer 208. The molding process creates a cohesive bond between the second polymer layer 232 and the first polymer layer 230. The materials of the first polymer layer 230 and the second polymer layer 232 may be the same (and/or have the same characteristics) as those of the respective first polymer layer 130 and second polymer layer 132 of FIG. 6.

In contrast to the embodiment of FIG. 6, however, the first polymer layer 230 includes at least one circumferential discontinuity in its outer surface. FIG. 9 shows a perspective view of the first polymer layer 230 molded onto the shaft 206 (not visible in FIG. 9) of the wooden part 209 apart from the second polymer layer 232. As shown in FIG. 9 the first polymer layer 230 includes an inner shaft 240 and a plurality of ribs 242 extending radially outward from the inner shaft 240 at different longitudinal locations. Each of the ribs 242 has a length that extends axially along at least the entire axial length the inner shaft 240. Each of the ribs 242 has a radial height that extends radially outward from the inner shaft 240. The ribs 242 are spaced apart such that portions of the inner shaft 240 separate adjacent ribs. The ribs 242 and the shaft 240 thereby define an outer surface 244 with circumferential discontinuities. By circumferential discontinuities, it is meant that the circumferential outer surface is not a continuous curve.

The discontinuities formed by the ribs 242 create torsion that assists in retaining the strong bond between the first polymer layer 230 and the second polymer layer 232. It will be appreciated that the ribs 242 may be replaced with some other structure on the shaft 240 that form such discontinuities. In this embodiment, the inner shaft 240 is roughly bullet shaped, have a substantially cylindrical body 250 extending from the head portion 204 and terminating in a rounded conical point 252. The ribs 242 extend along the entire length of the inner shaft 240, including the length of the rounded conical point 252, as shown in FIG. 9.

Figure 10:
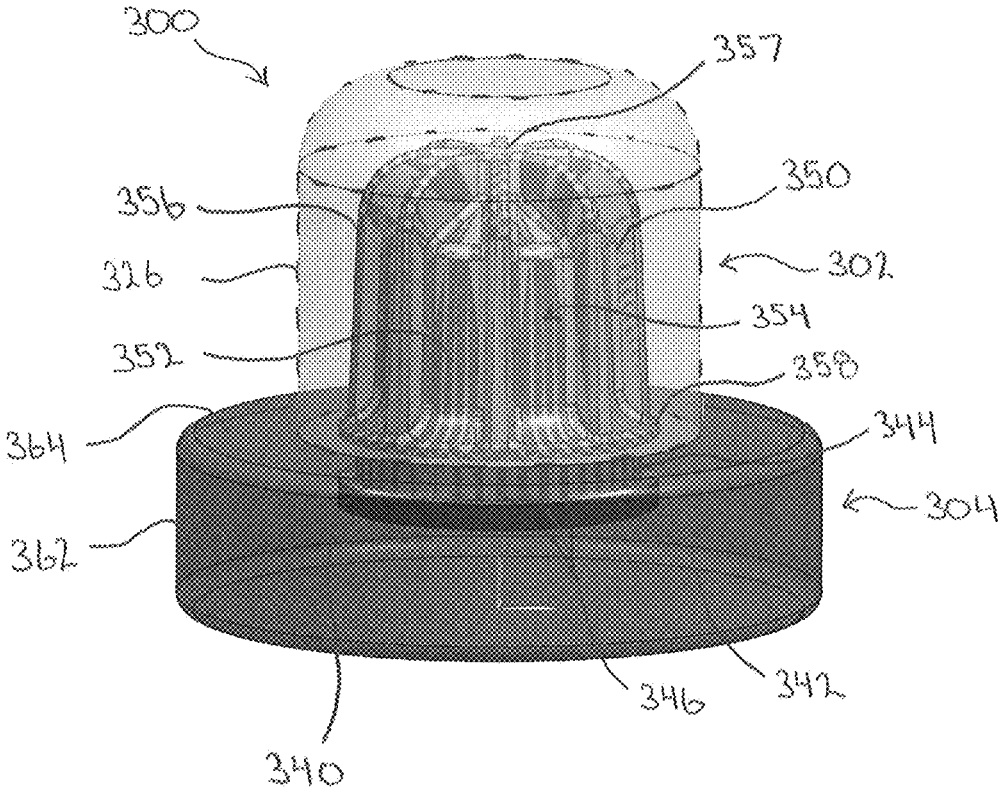
FIG. 10 shows a perspective view of yet another alternative, fourth embodiment of the bottle closure of FIG. 1, wherein the wood portion of the bottle closure includes a recess and the first polymer layer is molded into the recess.

FIGS. 10-12C illustrate an alternative embodiment of the bottle closure of FIGS. 7-9. FIG. 10 shows a perspective transparent view of a bottle closure 300 according to this alternative embodiment. The bottle closure 300 may suitably have an external appearance that is substantially identical to that of the closures 100 and 200, and thus has a plan view substantially identical that shown in FIG. 2. However, the internal structures of the bottle closure 300 differ from those of the bottle closures 100 and 200, as will become readily apparent upon review of FIGS. 10-12C.

Figure 11:
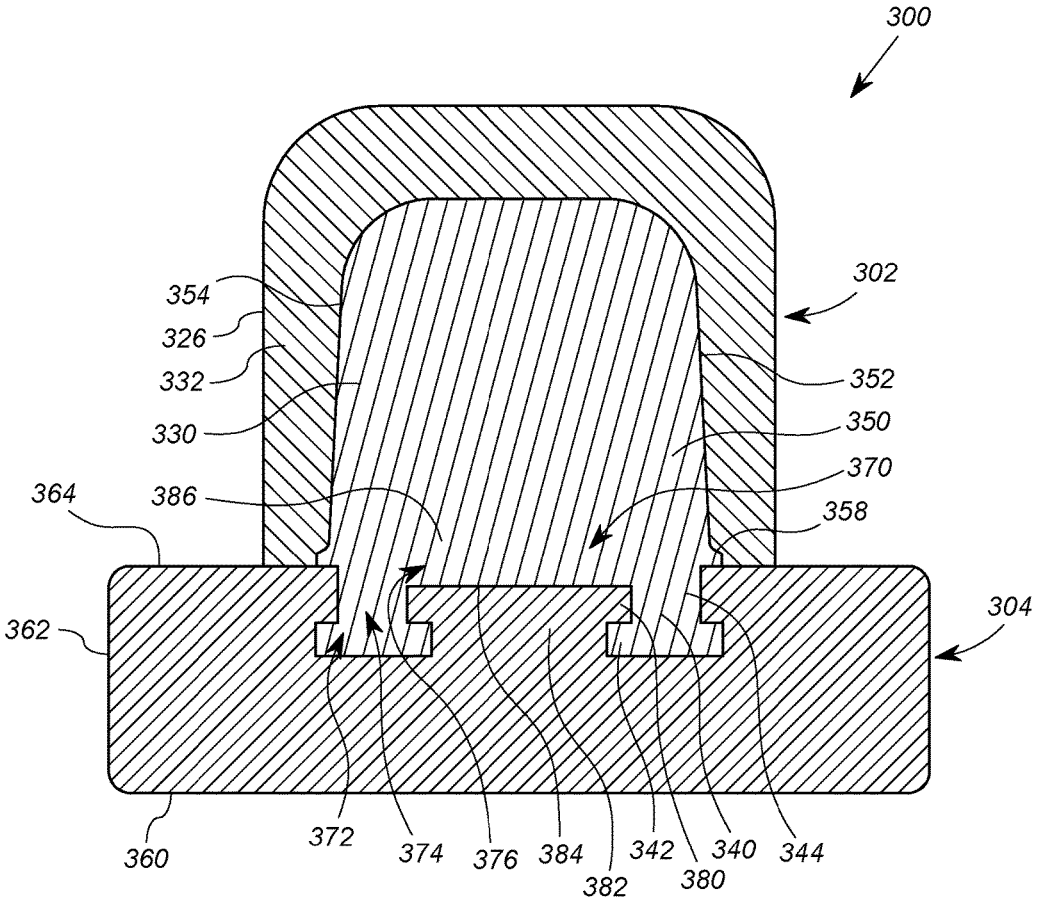
FIG. 11 shows an axial cross-sectional view of the bottle closure of FIG. 10.

Referring now to FIGS. 10 and 11, the alternative bottle closure 300 includes a stopper portion 302 and a head portion 304, and includes a substantially cylindrical outer wall 326 (shown in dotted lines in FIG. 10). The stopper portion 302 has an axial length and a width (OD of the outer wall 326) which may suitably be the same as that of the stopper portions 102 and 202 of the closures 100 and 200. In other words, the width of the stopper portion 302 is sized to be tightly received at least in part within the neck of a bottle containing spirits, wine, olive oil, maple syrup, mineral water, and other liquids, not shown. As with the stopper portion 202 in the previously described embodiments, the stopper portion 302 in the embodiment of FIGS. 10-12C is slightly compressed when inserted to form a liquid tight fit within the bottle. The head portion 304 has a width that exceeds the width of the stopper portion 302, and is not received within the neck of a standard bottle, but is rather configured to abut a top axial-facing edge of the bottle, as is conventional.

Unlike the previously described embodiments, the stopper portion 302 of the embodiment of FIGS. 10-12C does not include a wooden inner part (e.g., parts 106 and 206). Instead, the stopper portion 302 is comprised of a two-part polymer arrangement, including a polymer inner member 330 and a polymer outer member 332 (which two-part polymer arrangement may also be referred to herein as a two-layer polymer arrangement, including an inner layer 330 and an outer layer 332). The polymer inner layer 330 provides the interior structure of the stopper portion 302, and the polymer outer layer 332 provides the outer surface of the stopper portion 302.

The polymer inner layer 330 includes a footing 340 and an extension in the form of a knob 350. The footing 340 is substantially cylindrical in shape and includes an enlarged rim 342, a cylindrical wall 344, and a plurality of axial grooves 346 extending along the cylindrical wall 344. Both the rim 342 and the cylindrical wall 344 have a circular cross-sectional shape. As best shown in FIG. 11 the outer diameter of the footing 340 is greater at the rim 342 than at the cylindrical wall 344. Additionally, the inner diameter of the footing 340 is lesser at the rim 342 than at the cylindrical wall 344. Accordingly, the rim 342 provides an enlarged disc-like structure at the base of the footing 340 that protrudes radially inward and outward from the cylindrical wall 344. The cylindrical wall 344 extends away from the rim 342 in an axial direction. As explained in further detail below, the footing 340 is positioned within a recess 370 in the head portion 304.

The knob 350 includes a solid core member 352 with a substantially cylindrical shaft 354 that extends away from the footing 340 starting at a curved lip 358 that abuts a lower surface 364 of the wooden head portion 304. As best shown in FIG. 11, the knob 350 also includes a plurality of ribs 356 that extend radially outward from the substantially cylindrical shaft 354 at different longitudinal locations. Each of the ribs 356 has a length that extends axially along at least the entire axial length the inner shaft 354. Each of the ribs 356 has a radial height that extends radially outward from the inner shaft 354. The ribs 356 are spaced apart such that portions of the inner shaft 354 separate adjacent ribs. The ribs 356 extend from separate locations on the curved lip 358 and converge at an apex 357 at an outer end of the knob 350. The ribs 356 and the shaft 354 thereby define an outer surface with annular discontinuities (i.e., the circumferential outer surface is not provided as a structure with a continuous curve). The discontinuities formed by the ribs 356 create torsion that assists in retaining the strong bond between the first polymer layer 330 and the second polymer layer 332. It will be appreciated that the ribs 356 may be replaced with other structures on the shaft 354 that form such discontinuities. In the embodiment of FIGS. 10 and 11, the inner shaft 354 is roughly bullet shaped, having a substantially cylindrical body extending from the wooden head portion 304 and terminating in a rounded conical top that includes the apex 357. The ribs 356 extend along the entire length of the inner shaft 240, including the length of the rounded conical top, and converge in the apex 357, as shown in FIG. 10.

The footing 340 and the knob 350 of the polymer inner layer 330 are integrally formed from a single material such that the polymer inner layer 330 is configured as a unitary component. Accordingly, the footing 340 and the knob 350 are not separable without destruction of the polymer inner layer 330. Similar to the inner polymer layers 130, 230 of previous embodiments, the inner polymer layer 330 of the stopper portion 302 in the embodiment of FIGS. 10-12C, is comprised of a relatively hard and rigid polymer material (at least relative to the material of the outer polymer layer 332). The inner polymer layer 330 may be comprised of any of various polymer materials having a toughness that provides sufficient structural definition and support for the stopper portion 302, and sufficient fatigue resistance to allow the stopper portion to be used repeatedly over time. For example, in at least one embodiment, the inner polymer layer may be comprised of a polypropylene (PP) material or other material having similar elasticity, toughness, and fatigue resistance qualities.

The second polymer layer 332 provides a generally solid cylindrical structure that covers the inner polymer layer 330, including the core 352, ribs 356 and lip 358 of the inner polymer layer 330. The second polymer layer 332 provides a generally smooth and continuous outer cylindrical surface 326 for the stopper portion 302. The second polymer layer 332 is molded onto the first polymer layer 330 using a process and material that creates a cohesive bond between the second polymer layer 332 and the first polymer layer 330. Similar to the outer polymer layers 132, 232 of previous embodiments, the outer polymer layer 332 of the stopper portion 302 in the embodiment of FIGS. 10-12C, is comprised of a relatively soft and flexible polymer material (at least relative to the material of the inner polymer layer 332). For example, in at least one embodiment, the outer polymer layer 332 may be comprised of a thermoplastic elastomer such as silicone, nitrile or other food grade rubber materials.

Figure 12A:
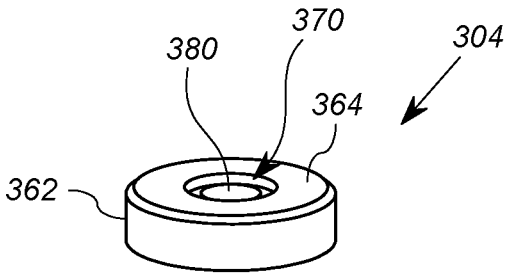
FIG. 12A shows a perspective view of the wood portion of the bottle closure of FIG. 10.
Figure 12B:
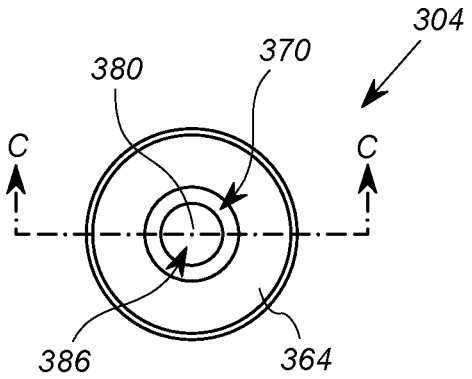
FIG. 12B shows a bottom view of the wood portion of the bottle closure of FIG. 10.
Figure 12C:
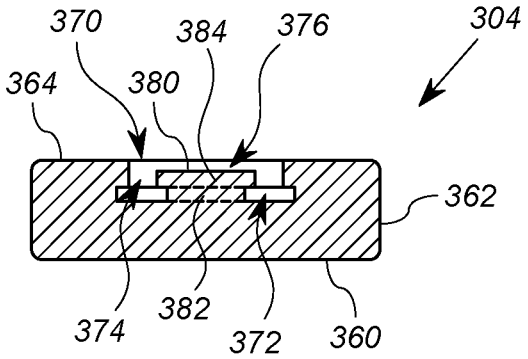
FIG. 12C shows a cross-sectional view of the wood portion of the bottle closure along line C-C of FIG. 12B.

With particular reference now to FIGS. 12A-12C, the wooden head portion 304 is shown. As noted previously, the wooden head portion 304 has a width that exceeds the width of the stopper portion 302, and is not received within the neck of a standard bottle, but is rather configured to abut a top axial-facing edge of the bottle, as is conventional. The wooden head portion 304 has a generally short circular-cylindrical shape, which may also be considered a disk shape. The wooden head portion 304 includes an upper surface 360, a lower surface 364, and a circular sidewall 362 extending between the upper surface 360 and the lower surface 364. In the disclosed embodiment, the upper surface 360 is generally flat and smooth without significant surface irregularities. However, in at least some embodiments, various logos or other designs may be printed, carved or otherwise formed in the upper surface 360.

The lower surface 364 of the wooden head portion 304 includes an outer circular surface 366, a central recess 370, and a mount 380. The outer circular surface 366 is configured to abut the rim of a bottle and is generally flat and smooth without significant surface irregularities. The central recess 370 includes a circular innermost portion 372, a circular intermediate portion 374, and a disk-shaped outermost portion 376. The circular innermost portion 372 and the circular intermediate portion 374 of the recess 370 define a two-stage annular groove having a T-shaped cross-section. The two-stage groove is comprised of two different radial widths, with a greater width defined by the circular innermost portion 372 (which provides the cross-member of the T-shaped cross-section) and a lesser width defined by the circular intermediate portion 374 (which provides the upright of the T-shaped cross-section).

The circular mount 380 is positioned at the center of the recess 370 and is comprised of wooden material. The circular mount 380 includes a base 382 and a platform 384, the platform 384 having a greater diameter than the base. Because the platform 384 has a greater diameter than the base 382, a shoulder is formed between the base 382 and the platform 384. The base 382 may further include a number of axial ribs that compliment and engage the axial grooves 346 in the footing 340 of the polymer inner member 330. The circular innermost portion 372 of the recess 370 is formed around the base 382, and the circular intermediate portion 374 of the recess 370 is formed around the platform. As noted above, the radial width of the two-stage groove defined by the recess 370 is greater at the innermost portion 372 than at the narrower intermediate portion 374. This two-stage groove results in undercuts in the wooden head at the shoulder in the mount 380 between the base 382 and the platform 384, and these undercuts are used to lock the polymer inner member 330 onto the wooden head portion 304, as noted below. Additionally, the disk-shaped outermost portion 376 of the central recess 370 is formed adjacent to the platform 384 and extends across the entire outer surface 386 of the platform 384, such that the radial width of the recess 370 is greatest at the outermost portion 376. Because of this, the outer surface 386 of the platform is provided in a different plane than the lower surface 364 of the wooden head portion 304, with the two relatively flat surfaces separated by the depth of the outermost portion 376 of the central recess 370.

As best shown in FIG. 11, and in view of the description above, it will be recognized that the polymer inner layer 330 of the stopper portion 302 is embedded in the wooden head portion 304 of the bottle closure 300. In particular, the footing 340 of the polymer inner layer 330 is positioned in the recess 370 of the wooden head portion, with the rim 342 of the footing 340 formed in and substantially filling the innermost portion 372 of the recess 370, and the cylindrical wall 344 of the footing 340 formed in and substantially filling the intermediate portion 374 of the recess 370. Accordingly, the footing 340 substantially fills the recess 370 and encompasses the mount 380. Because the rim 342 of the footing 340 has a greater outer diameter and smaller inner diameter than the than the cylindrical wall 344 of the recess, the polymer inner layer 330 is trapped in place and thus the stopper portion 302 of the bottle closure 300 is secured to the wooden head portion 304 of the bottle closure. In other words, when the polymer inner layer 330 fills the two-stage groove provided by the recess 370, it locks into the undercuts provided at the shoulder in the mount 380 of the wooden head portion 304, thus securing the stopper portion 302 to the wooden head portion 304 of the bottle closure 300. Advantageously, this embodiment results in cost savings for the bottle closure 300, as wood tends to be the most expense part of the bottle closure, and less wood is required to manufacture this embodiment. For example, while other embodiments with a wood shaft may require a 1" wood block, the present embodiment may only require a ½" wood block.

The foregoing arrangement also provides for a method of making a bottle closure 300. The method includes forming a recess 370 in a wooden head portion 304. The recess may be formed from any of a plurality of suitable methods, including machining, carving or otherwise cutting the wood of the wooden head portion 304. The method also comprises molding a polymer inner member 330 on the wooden head portion 304. Molding the polymer inner member 330 includes filling the recess 370 with a relatively hard polymer material in order to provide a polymer inner member 330. The polymer inner member 330 includes a footing 340 that is embedded in the wooden head portion 304 and an extension 350 that extends outward from the wooden head portion 304. The method further comprises molding a polymer outer layer 332 on the polymer inner member 330. The polymer outer layer 332 is comprised of a relatively soft polymer material that substantially cover the polymer inner member 330 and abuts the wooden head portion 304. Together, the polymer inner member 330 and the polymer outer member 332 form the stopper portion of the bottle closure 300.

It will be appreciated that the above-described embodiments are merely illustrative, and that those of ordinary skill in the art may readily devise their own implementations and modifications that incorporate the principles of the present invention and fall within the spirit and scope thereof. By way of example, it will be appreciated that the dimensions of the closures 100, 200, 300 may be altered to suit the bottle neck design. In addition, the length of the stopper portions 102, 202, 302 and width of the head portion 104, 204, 304 may be altered without departing from the principles of the embodiments described herein.

In addition, it will be appreciated that the discontinuities used to strengthen the bond between the wood shafts 106, 206 and the polymer out layer(s), and as well as the discontinuities used to strengthen the bond between the polymer inner layer 330 and the polymer outer layer 332 may take different forms. Additionally, the bond between the polymer inner layer 330 and the recess 370 in the wooden head portion 304 may take different forms. While the embodiment described herein relies on annular grooves and hollow spots chipped out during machining, at least some embodiments may rely solely on discontinuities formed by chipped-out hollow spots formed during the machining of the shaft or the head portion 104, 204, 304. In addition, other forms of chipping or forming of overhangs the shaft may be employed. Nevertheless, the use of at least two annular grooves has been shown to provide particularly reliable connection between the wood shafts 106, 206 and the polymer outer parts 108, 208, as well as the embedding of the polymer inner layer 330 in a mount 380 in a recess 370 the wooden head portion 304.

The foregoing detailed description of exemplary embodiments of the bottle closure having a wood top have been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. A closure for a bottle, comprising:

a wooden head portion having a recess formed therein; and a stopper portion having a polymer inner member and a polymer outer member, the polymer inner member including a first part embedded in the recess in the wooden head and a second part extending away from the wooden head and substantially covered by the polymer outer member, wherein the wooden head portion includes a mount arranged within the recess, the mount defining a first diameter and a second diameter that is greater than the first diameter, the first part of the polymer inner member substantially filling the recess and encompassing the mount.

2. The closure of claim 1, wherein the first part of the polymer inner member is a footing and the second part of the polymer inner member is a knob member, the footing and the knob member integrally formed as a unitary component.

3. The closure of claim 2 wherein the knob member includes a substantially cylindrical portion and a plurality of ribs that extend radially outward from the substantially cylindrical portion at different annular locations.

4. The closure of claim 1, wherein the mount includes a base and a platform, the base defining the first diameter and the platform defining the second diameter, and wherein the radial width of the recess is greater at the base than at the platform.

5. The closure of claim 4 wherein the wooden head includes a lower surface and the platform within the recess includes an outer surface that is not co-planar with the lower surface.

6. The closure of claim 4 wherein the base includes a plurality of axial ribs that complement and engage a plurality of axial grooves in the first part of the polymer inner member.

7. The closure of claim 1, wherein the polymer inner member is comprised of a different material than the polymer outer member.

8. The closure of claim 7, wherein the polymer outer member abuts a lower surface of the wooden head portion.

9. A closure for a bottle, comprising a wooden element having a recess formed therein;

a first polymer layer molded into the recess in the wooden element, the first polymer layer having an outer surface having at least one circumferential discontinuity;

a second polymer layer disposed over the first polymer layer, the second polymer layer configured to be received by a bottle in the axial direction;

wherein the first polymer layer includes an inner shaft, and wherein the at least one circumferential discontinuity comprises a plurality of ribs extending radially outward from the shaft, wherein the each of the plurality of ribs extends axially along said inner shaft, wherein the head has a width that exceeds a width of an opening in the bottle, and wherein the wooden element includes a mount arranged within the recess, the mount defining a first diameter and a second diameter that is greater than the first diameter, the first polymer layer substantially filling the recess and encompassing the mount.

10. The closure of claim 9, wherein the mount includes a base and a platform, the base defining the first diameter and the platform defining the second diameter, and wherein the radial width of the recess is greater at the base than at the platform.

11. The closure of claim 10 wherein the wooden element includes a lower surface and the platform within the recess includes an outer surface that is not co-planar with the lower surface.

12. The closure of claim 10, wherein the first polymer layer has a different hardness than the second polymer layer.

13. A closure for a bottle, comprising:

a wooden element having an upper surface, a lower surface, and a recess formed in the lower surface;

a first polymer layer including a footing and an extension, the footing molded into the recess in the wooden element, and the extension extending away from the footing and the wooden element, the footing integrally formed with the extension as a unitary component; and a second polymer layer molded onto the first polymer layer and configured to be received by a bottle in the axial direction, wherein the first polymer layer has a different hardness than the second polymer layer, and wherein the recess defines a two-stage annular groove in the wooden element.

14. The closure of claim 13, wherein the extension includes a substantially cylindrical portion and a plurality of ribs that extend radially outward from the substantially cylindrical portion at different annular locations.

15. The closure of claim 14 wherein the second polymer layer abuts the lower surface of the wooden element.

16. The closure of claim 15, wherein each of the plurality of ribs extends axially along said substantially cylindrical portion.

17. The closure of claim 14, wherein each of the plurality of ribs extends axially along said substantially cylindrical portion.

* * * * *